US005215510A

United States Patent [19]

Baran

[11] Patent Number: 5,215,510

[45] Date of Patent: Jun. 1, 1993

[54] DUAL-GUIDED EXERCISE APPARATUS

[76] Inventor: John Baran, 17 Falmouth Dr., Mt. Laurel, N.J. 08054

[21] Appl. No.: 760,274

[22] Filed: Sep. 16, 1991

[51] Int. Cl.[5] ..... A63B 21/078

[52] U.S. Cl. ..... 482/104; 482/45

[58] Field of Search ..... 482/45, 101, 98, 104, 482/118, 112, 113, 106, 108

[56] References Cited

U.S. PATENT DOCUMENTS

| | | | |
|---|---|---|---|
| 3,235,255 | 2/1966 | Leflar | 482/104 |
| 3,359,802 | 12/1967 | Sollenberger | 482/113 X |
| 3,606,318 | 9/1971 | Gilstrap | 482/112 |
| 4,252,314 | 2/1981 | Ceppo | 482/104 |
| 4,527,797 | 7/1985 | Slade, Jr. et al. | 482/104 X |
| 4,564,194 | 1/1986 | Dawson | 482/104 X |
| 4,664,370 | 5/1987 | Finch | 482/45 |
| 4,744,560 | 5/1988 | Azari | 482/104 X |
| 4,795,149 | 1/1989 | Pearson | 482/98 |
| 4,934,693 | 6/1990 | Santoro | 482/104 X |
| 4,974,838 | 12/1990 | Sollenberger | 482/101 |
| 4,979,737 | 12/1990 | Kock | 482/118 X |
| 5,050,868 | 9/1991 | Pearson | 482/104 X |

FOREIGN PATENT DOCUMENTS

| | | | |
|---|---|---|---|
| 1447999 | 6/1966 | France | 482/104 |
| 2328486 | 5/1977 | France | 482/104 |

*Primary Examiner*—Robert Bahr
*Attorney, Agent, or Firm*—Norman E. Lehrer

[57] ABSTRACT

An exercise apparatus for safely assisting a person to lift weights which incorporates concurrently functioning vertical and horizontal guidance mechanisms. The exercise apparatus is comprised of a frame including two rectangularly shaped parallel aligned structures having four horizontally extending support members, a lifting bar, a horizontal guidance mechanism, and a vertical guidance mechanism. The horizontal support members function also as the horizontal guidance bars. Each horizontal guidance bar has a bearing block slidably attached thereto via a linear bearing. Pairs of bearing blocks are connected to the ends of two vertically extending guidance bars which move horizontally via their attachment to the bearing blocks. Similarly, the vertical bars have bearing blocks with linear bearings attached thereto which are also connected to the ends of the lifting bar. The lifting bar moves vertically along the vertical bars and moves horizontally via the vertical bars' connections to the horizontally moving bearing blocks. The vertical bars are pivotally attached to the horizontal bearing blocks at their bottom end to compensate for any minor bearing misalignment. The apparatus can be used for a variety of exercises where the weight is pushed or pulled in the vertical direction. The horizontal guidance feature allows the apparatus to adjust to the human body's natural propensity to pull towards or push away while pushing up or pulling down, the attached weight.

8 Claims, 1 Drawing Sheet

DUAL-GUIDED EXERCISE APPARATUS

BACKGROUND OF THE INVENTION

This invention relates to exercise apparatuses used for assisting a person lifting barbells. More particularly, the invention is directed toward equipment which allows a person to workout alone without the assistance of another.

Many prior inventions meeting this categorical description have been proposed and employ the usage of guides for guiding the weight and allowing, at any point in a workout, a safe method of discontinuing the exercise. In the prior art, exercise machines employing vertically directed guide means are disclosed.

U.S. Pat. No. 4,934,693 to Santoro, for example, discloses a device for assisting a person to perform various exercises. The apparatus employs the use of vertical guides for guiding barbells. The device uses pins and holes to set various start and finish positions for the bar which also allow the user to discontinue exercising by allowing the weight to rest at these pinned points. However, the device does not incorporate any method for moving the weight in the horizontal direction.

In U.S. Pat. No. 4,740,739 to Lange, an apparatus is disclosed which uses compressed gas to add sudden downward force to a lifting bar that must be overcome by a user. The device is designed for developing explosive reactive power in the muscles being exercised. The invention uses a guiding system which limits movement to the vertical direction.

U.S. Pat. No. 4,744,560 to Azari discloses a multistation exercise machine for performing a large variety of exercises. Particularly, one station of the apparatus discloses a spring loaded vertically guided weight bearing bar which, again, is limited to vertically directed motion.

Similar to Santoro, U.S. Pat. No. 4,527,797 to Slade, Jr., discloses a structure which vertically guides a weight bearing bar. Rods are used to set start and finish positions for the weight bar and allow the user to start and discontinue at these points. The invention, again, limits the motion of the weight bar to the vertical direction.

U.S. Pat. No. 4,252,314 to Ceppo and U.S. Pat. No. 4,420,154 to Ramsey disclose vertically guided weight lifting mechanisms. Neither of these inventions allows any movement in the horizontal direction. Similarly, U.S. Pat. No. 4,153,244 to Tauber, Jr., discloses an exercise apparatus for use by handicapped people which also has a method for vertically guiding a weight bearing bar.

Finally, U.S. Pat. No. 3,235,255 to Leflar, discloses a frame for assisting a person performing a variety of push and pull type exercises with a weight bearing bar. The frame employs the use of guiding mechanisms in two distinct formats. The first format discloses a purely vertically directed method for guiding a weight bearing bar. The second method illustrates the same method for guiding another weight bearing bar on the frame, but in an angularly directed manner. The angular direction, however, is fixed for every user and cannot be adjusted.

SUMMARY OF THE INVENTION

The invention in the present application is an apparatus for assisting a person to safely lift weights. The apparatus can be used for a variety of exercises and it incorporates concurrently functioning vertical and horizontal guidance mechanisms.

In accordance with the invention, the apparatus comprises a frame including a pair of rectangularly shaped structures with horizontal support members, a lifting bar, a horizontal guidance mechanism, and a vertical guidance mechanism. The guidance systems comprise two identical halves which are located on opposite sides of the frame. The horizontal guidance system has four horizontally extending bars, located on the frame in pairs. The bars are spaced apart having a bearing block with a bearing therein slidingly attached to each bar. The blocks glide on the bars in the horizontal direction. A vertical guidance bar is attached to and between two horizontal bars and their respective bearing blocks, on each side. Each vertical bar has a bearing block, with a bearing, slidingly attached thereto. The lifting bar is rotatably but not slidably attached to the same vertical bearing blocks. The lifting bar moves on a vertical plane with the vertical bearing blocks and can also move on a horizontal plane due to the attachment of the vertical bars to the horizontal bearing blocks. The lower attachment of the vertical bars to the horizontal bearing blocks is pivotal to allow compensation for any bearing misalignment on the horizontal bars.

The apparatus can be used for a variety of exercises where the weight is pushed or pulled in the vertical direction. The horizontal motion guidance feature allows for the apparatus to adjust to the body's propensity to pull towards or push away the weight while pushing up or pulling down the same.

The instant invention maintains all the advantages of other vertically guided lifting mechanisms including safety, guidance, and lack of need for a "spotter". In addition, however, the instant invention allows for horizontal motion. The advantage here follows from the advantage in using free weights and the natural tendencies of the human body.

Free weights are a very beneficial form of workout for they require the user to maintain control of the weight as well as push or pull the weight upward. This effect provides a well rounded workout in terms of exercising many muscles. However, free weights have the disadvantage of being relatively unsafe if used alone. For example, if the weight becomes too heavy or if balance is lost while exercising alone, disastrous consequences such as strained muscles, pulled ligaments, and even broken bones can result. The advantage of the instant invention is that it requires an amount of control similar to free weights due to concurrent horizontal and vertical movement being permissible. However, the guidance mechanisms allow the user to workout alone and safely by enabling the user to simply discontinue if balance is lost or if the weight becomes too heavy.

The instant invention also has the advantage of conforming to the natural tendencies of the human body. While lifting weights, the body's natural movements do not conform to a perfect vertical plane. Solely vertically guided prior mechanisms therefore, require the body to contort in some manner to conform to the single dimensional movement. The instant invention accommodates the body's natural tendencies by allowing a natural amount of horizontal motion of the arms and weight concurrent with vertical motion. This feature helps to prevent injury and is conducive to more efficient and natural workouts.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENTS

Figure 1:
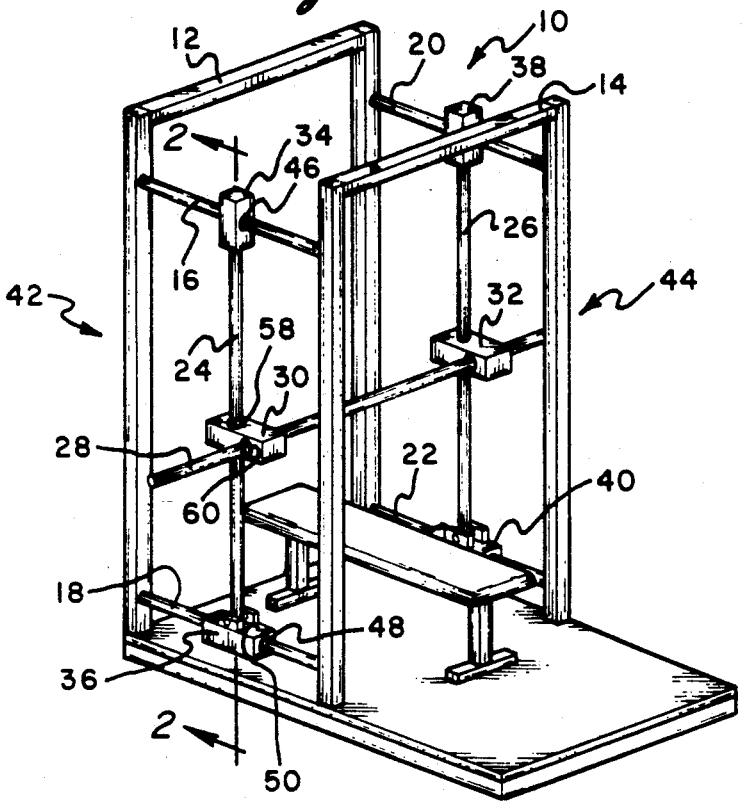
FIG. 1 is a perspective view of the dual-guided exercise apparatus constructed in accordance with the principles of the present invention.

Referring now to the drawings in detail wherein like reference numerals have been used throughout the various figures to designate like elements there is shown in FIG. 1 a perspective view of the dual-guided exercise apparatus constructed in accordance with the principles of the present invention and designated generally as 10.

The dual-guided exercise apparatus is comprised of a frame consisting of two rectangular structures 12 and 14 connected by four horizontal support members or guiding bars 16, 18, 20 and 22. The apparatus further includes two vertically extending guiding bars 24 and 26, a lifting bar 28, two vertical guiding blocks with bearings 30 and 32 and four horizontal guiding blocks having bearings 34, 36, 38 and 40.

Referring now to FIG. 1, the structures 12 and 14 comprising the frame are substantially rectangular in shape and identical in appearance. The structures are preferably constructed from square metal tubing, preferably steel, and welded or similarly joined together at their connecting ends. The rectangular structures 12 and 14 extend upwardly from the floor and are of a height to allow fully upright exercise by a user situated under their top portion. The structures are positioned parallel to each other and in substantial alignment as shown best in FIG. 1.

The horizontal support members 16, 18, 20 and 22 are attached to the rectangular structure 12 and 14 for support. The support bars are positioned between and attached to the vertical inside surfaces of each structure and located in pairs, 16 and 18 on the left side and 20 and 22 on the right side. The bars 16 and 18 are in horizontal alignment with their counterpairs 20 and 22, respectively. The bars 16 and 20 are located towards the top end of the structures 12 and 14 and bars 18 and 22 are located towards the bottom end of the structures. Each bar is preferably round in shape and attached to the structures at their ends by welding or other rigid affixation. Each horizontal support member 16, 18, 20 and 22 also acts as a horizontal guide for the lifting bar 28.

The two sides of the exercise apparatus 10 are substantially identical and are designated as the left side 42 and right side 44. Accordingly, only the guiding means of the left side 42 will be described in detail, it being understood that the following description applies equally to the right side 44 of the apparatus 10.

Figure 2:
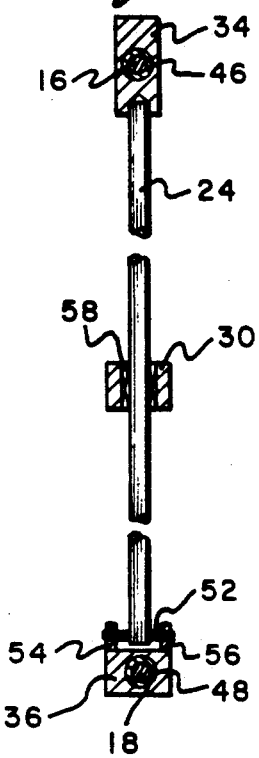
FIG. 2 is a cross-sectional view taken along line 2—2 of FIG. 1.
Figure 3:
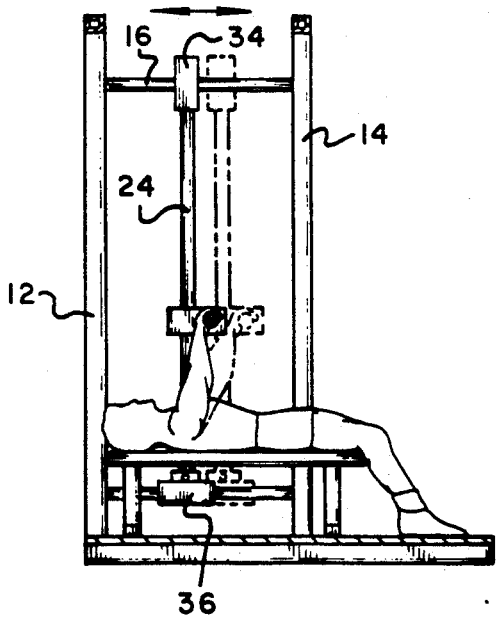
FIG. 3 is a side view of the dual-guided exercise apparatus which also illustrates its feature permitting independent horizontal motion.

The exercise apparatus 10 has two guiding mechanisms, a horizontal guiding mechanism and a vertical guiding mechanism. The horizontal guiding mechanism is shown in FIGS. 1, 2 and 3. For the left side 42, upper and lower horizontal bars 16 and 18, respectively, and upper and lower horizontal guide blocks 34 and 36, respectively, comprise the guiding mechanism in the horizontal direction. The bars 16 and 18 are round in shape to slidingly fit a linear bearing or the like. The bearings 46 and 48 are pressed within bearing blocks 34 and 36, respectively, and placed onto the horizontal guide bars 16 and 18, respectively. The blocks 34 and 36 move smoothly along their respective bars 16 and 18. The bearing blocks 34 and 36 are not identical. The upper block 34 is rectangular in shape having the bearing 46 pressed into the block such that the block's length runs perpendicular to the bar 16. However, while the lower block 36 is similarly rectangularly-shaped, it is preferably larger, having its length run parallel with the bar 18. The bearing 48 is therefore longer for it must run the length of the block 48 as opposed to its width as in block 34. Bearing block 48 is larger and positioned such that its length is parallel to the bar 18 to accommodate an additional feature, a means for pivotal attachment of the vertical bars.

The horizontal surface 50 of the block 36, being the length of the block, is large and flat having means to accommodate a pivotal attachment of the vertical guidance bar 24. The end of the vertical bar 24 is pivotally attached via a pin 52 and pivot blocks 54 and 56. The bearing block 36 has two pivot blocks 54 and 56 each located flush with block's widthwise edges. The pivot blocks are rectangular in shape, spaced apart, and centered on the lengthwise centerline of the bearing block 36. Each pivot block has a hole through which a pin 52 fits to secure the vertical guide bar 24. The pivot feature allows the vertical guide bars 24 and 26 to compensate for minor misalignment of the bearings on the horizontal bars.

The vertical guide bars 24 and 26 are attached to the horizontal bearing blocks, 34 and 36, and 38 and 40, respectively. At the bottom end of each vertical bar 24 and 26, the bars are pivotally attached to bearing blocks 36 and 40 respectively. At the top end, vertical bars 24 and 26 are rigidly attached to the bearing blocks 34 and 38, respectively. The vertical bars can move horizontally using the horizontal guide bars and horizontal bearing blocks.

The vertical guide mechanism on the left side comprises the vertical bar 24, bearing block 30 and the lifting bar 28. The vertical guide bar 28 is round in shape to slidingly fit a bearing 58. The bearing 58 is press fit into the bearing block 30 thereby allowing guided motion of the bearing block 30 in the vertical direction. The bearing block 30 is rectangularly-shaped and located on the vertical bar such that its length runs perpendicular to the vertical bar 24. The vertical bearing 58 is press fit at one end of the block through its height which is shorter than its width. A second bearing 60 or the like, is press fit through the width of the block 30 at an end opposite the vertical bearing 58. The second bearing 60 runs perpendicular to the vertical bar 24 and vertical bearing 58. The lifting bar 28 fits through the second bearing 60 but is immobilized in the linear direction preferably via snap rings or the like. The lifting bar 28 does rotate within the bearings. The lifting bar 28 can be moved in the vertical direction via the vertical bars, 24 and 26, and bearing blocks 30 and 32. Similarly, the lifting bar is moved horizontally via the vertical bars' connection to the horizontal guidance mechanism.

The dual guide exercise apparatus 10 can be used for a variety of exercises including bench presses, shoulder presses, squats and standing pull-ups. For any of the above exercises or any others, the user positions himself accordingly, relative to the apparatus. The user grabs the lifting bar and lifts, pulls or pushes the bar in the vertical direction. Because of the propensity of the human body to sway and push out or pull in as well as up and down, the horizontal guidance mechanism allows concurrent horizontal and vertical motion of the lifting bar.

Figure 4:
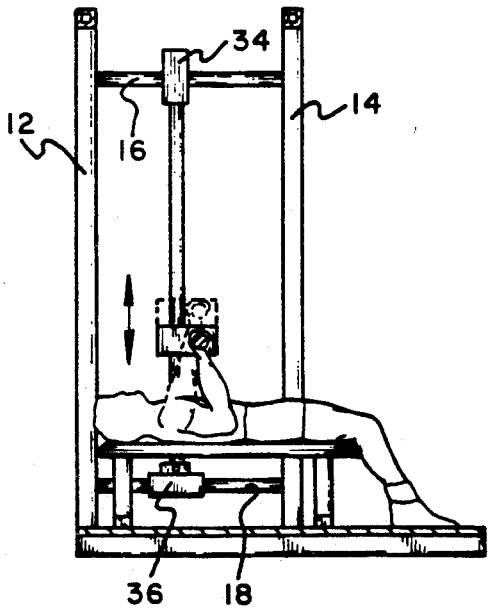
FIG. 4 is a side view of the dual-guided exercise apparatus illustrating the independant vertical motion feature of the invention and also a method of use for the invention.

FIGS. 3 and 4 show the apparatus being used in the bench press orientation. The user lies under the lifting bar and grasps it with both hands. As shown in FIG. 4, the user can push up solely in the vertical direction if desired. However, FIG. 3 indicates a normal lifting movement showing concurrent horizontal movement of the lifting bar due to the propensity of the arms to push away as well as up. The apparatus allows free moving concurrent horizontal and vertical motion resulting in an angular path of movement which is more conducive to the body's natural propensities. The user shown in the FIGS. 3 and 4 orientation, then returns along the same path of movement and repeats the exercise as desired.

The instant application discloses only the inventive aspects of the exercise apparatus, this primarily being the independent horizontal and vertical guidance mechanisms. However, it should be understood that safety features common in the art may be used with the present invention. For example, braking mechanisms for preventing sudden free falls, or locks between the lifting bar and the guidance mechanisms for positioning the bar at preselected positions which are, per se, known in the art may be employed.

The present invention may be embodied in other specific forms without departing from the spirit or essential attributes thereof and accordingly reference should be made to the appended claims rather than to the foregoing specification as indicating the scope of the invention.

What is claimed is:

1. An exercise apparatus for aiding a person to safely lift weights, comprising a plurality of weights, a frame, a lifting means for supporting said weights, and a means for attaching said lifting means to said frame such that said lifting means and said weights are capable of independent horizontal motion and independent vertical motion and said lifting means and said weights are capable of concurrent horizontal and vertical motion, said attaching means comprising vertical guide means comprised of a single vertically extending bar located on each side of said frame for guided vertical motion of said lifting means and top and bottom horizontal guide means for guided horizontal motion of said lifting means, said lifting means being attached to said vertically extending bars, said vertically extending bars being pivotally attached to said horizontal guide means at at least one of the tops and bottoms of each of said bars and said horizontal guide means being attached to said frame.

2. The invention according to claim 1 wherein said lifting means comprises an elongated lifting bar having means for changing the amount of weight supported thereby.

3. The invention according to claim 2 wherein said frame comprises a pair of spaced apart up-standing rectangularly-shaped structures, said horizontal guide means extending between said structures and attached thereto.

4. The invention according to claim 3 wherein said horizontal guide means are comprised of two pairs of horizontally extending elongated bars, one pair on each side of said frame; said bars of each pair being positioned between and attached to said structures; said bars being located and spaced apart on inside vertical surfaces of said structures, wherein each of said bars has a bearing slidingly attached thereto.

5. The invention according to claim 4 wherein said vertically extending bars are positioned between said horizontally extending bars, one on each side of said frame; each end of said vertical bars is attached to said bearings which are slidingly attached to said horizontal bars and, each of said vertical bars having a bearing slidingly attached thereto.

6. The invention according to claim 5 wherein said bearings attached to said vertical bars are rotatably attached at opposite positions onto said lifting bar, wherein said positions are adjacent to the ends of said lifting bar.

7. The invention according to claim 2 wherein said changing means comprises the ends of said elongated bar of said lifting means being adapted to slidingly fit interacting weights being readily attachable and removable.

8. The invention according to claim 7 wherein said bearings are enclosed by bearing blocks and press fit therein.

* * * * *